US009230523B1

(12) United States Patent
Spriggel

(10) Patent No.: US 9,230,523 B1
(45) Date of Patent: Jan. 5, 2016

(54) CYMBAL MOUNTING ASSEMBLY WITH CENTERING CLIP

(71) Applicant: Daniel John Spriggel, Bermuda Dunes, CA (US)

(72) Inventor: Daniel John Spriggel, Bermuda Dunes, CA (US)

( * ) Notice: Subject to any disclaimer, the term of this patent is extended or adjusted under 35 U.S.C. 154(b) by 0 days.

(21) Appl. No.: 14/756,001

(22) Filed: Jul. 17, 2015

Related U.S. Application Data

(63) Continuation-in-part of application No. 14/545,525, filed on May 18, 2015.

(51) Int. Cl.
*G10D 13/06* (2006.01)

(52) U.S. Cl.
CPC ..... *G10D 13/06* (2013.01)

(58) Field of Classification Search
CPC ..... G10D 13/065; G10D 13/00; G10H 2230/331; G10H 2230/321; F16C 35/06; F16F 1/121
USPC ..... 84/422.1, 422.2, 422.3
See application file for complete search history.

(56) References Cited

U.S. PATENT DOCUMENTS 4,319,514 A * 3/1982 Donohoe ..... G10D 13/06 84/421
4,889,028 A * 12/1989 Lombardi ..... G10D 13/06 84/421

* cited by examiner

*Primary Examiner* — Kimberly Lockett
(74) *Attorney, Agent, or Firm* — Jack C. Munro

(57) ABSTRACT

A cymbal mounting assembly that has a housing with a through hole. A mounting rod of a cymbal stand is to be conducted through the through hole with therebeing a loose fit between the mounting rod and the housing. A cymbal is loosely mounted on the housing so it can freely pivot or rock. The assembly includes a tightening nut with a friction feature included to adjust the amount of clamping force being applied to the cymbal. This friction feature prevents unauthorized adjusting of the rocking or pivoting motion (action) of the cymbal and this preselected amount of action by the drummer is maintained even when the cymbal is placed in storage when the drummer moves to another playing location and is only changed when the drummer decides to do so. The assembly may also include a centering clip within the through that prevents the housing from contacting the mounting rod in the area of the upper portion of the assembly.

7 Claims, 5 Drawing Sheets

CYMBAL MOUNTING ASSEMBLY WITH CENTERING CLIP

REFERENCE TO PRIOR APPLICATION

This application is a continuation-in-part of U.S. patent application Ser. No. 14/545,525, entitled Cymbal Mounting Assembly, by the present inventor.

BACKGROUND OF THE INVENTION

A cymbal is a metallic disc that has a center hole for mounting on a mounting stand. The cymbal is to be struck by a drummer with a drumstick creating a sharp sound that is desired when playing music. The cymbal can be tightly mounted on the mounting rod of the cymbal stand which will produce a muted sound or loosely mounted which will produce a freely vibrating sound. Actually the loose mounting can be adjusted to produce various different sounds.

The cymbal clamp assembly of the prior art required it to be assembled and installed in conjunction with the cymbal and the mounting rod. Disassembly is frequent as musicians commonly move between performing locations. The parts of the cymbal clamp assembly are separated and can be misplaced or lost when traveling between locations. This frequently results in the cymbal becoming inoperable. The prior art cymbal clamp assemblies are separate from the cymbal which encourages this misplacement or losing of the parts. There are up to five different parts of the prior art clamping arrangement which further encourages this misplacement or losing. The drummer also handles the cymbal which contaminates the surface of the cymbal with oil from the drummer's hands. Accumulation of this oil will slightly change the sound produced by the cymbal which is not desirable. Also, some prior art cymbal clamp assemblies utilize a threaded tube and a threaded hole which is located perpendicular to the mounting rod to bite into the mounting rod. This biting deteriorates the mounting rod requiring premature replacement.

Each time a cymbal is to be played it has to be adjusted to determine the amount of rocking or pivoting motion of the cymbal. It would be desirable to not have to set the amount of rocking motion at each performance.

SUMMARY OF THE INVENTION

A cymbal mounting which is not clamped to the mounting rod of the cymbal stand. The cymbal mounting assembly of this invention has housing through which is formed a longitudinal center through hole. The housing is composed of a metal insert or inserts which are fixedly mounted within a knob and a ring. The center through hole passes through the metal insert(s). A mounting rod of a cymbal stand is to be passed through this through hole. The through hole is oversized relative to the diameter of the mounting rod and is constant in the embodiment of FIGS. 1-5. The knob facilitates manual grasping by the drummer for installing and removing of the cymbal on the mounting rod eliminating the need for the drummer to ever touch the cymbal. This knob can also permit the drummer to support the cymbal free of the cymbal stand and strike the cymbal using the drummer's other hand. The cymbal is clamped between a pair of soft discs mounted on the assembly with pressure being applied to the upper soft disc by the ring. The amount of rocking or pivoting motion (action) can be preselected by the drummer and once set will remain at the selected level since the assembly is permanently mounted on the cymbal. The assembly remains with the cymbal when in storage between playing times. The assembly can be used when stacking a plurality of cymbals and removed from the storage location in the stacked position not requiring such to be built on stage. The stacking of a plurality of cymbals together may be of different diameters and is usually just two cymbals.

The metal insert is constructed of two pieces in the embodiment of FIGS. 6 and 7 with a centering clip being clamped there between. The metal insert has an upper piece mounted within knob 22 and a lower piece mounted within ring 12. The centering clip has a plurality of spring fingers that are to resiliently press against the mounting rod preventing such from vibrating against the metal insert and making an undesirable noise and keeping the mounting rod centered relative to the housing.

DETAILED DESCRIPTION OF THE INVENTION

Figure 1:
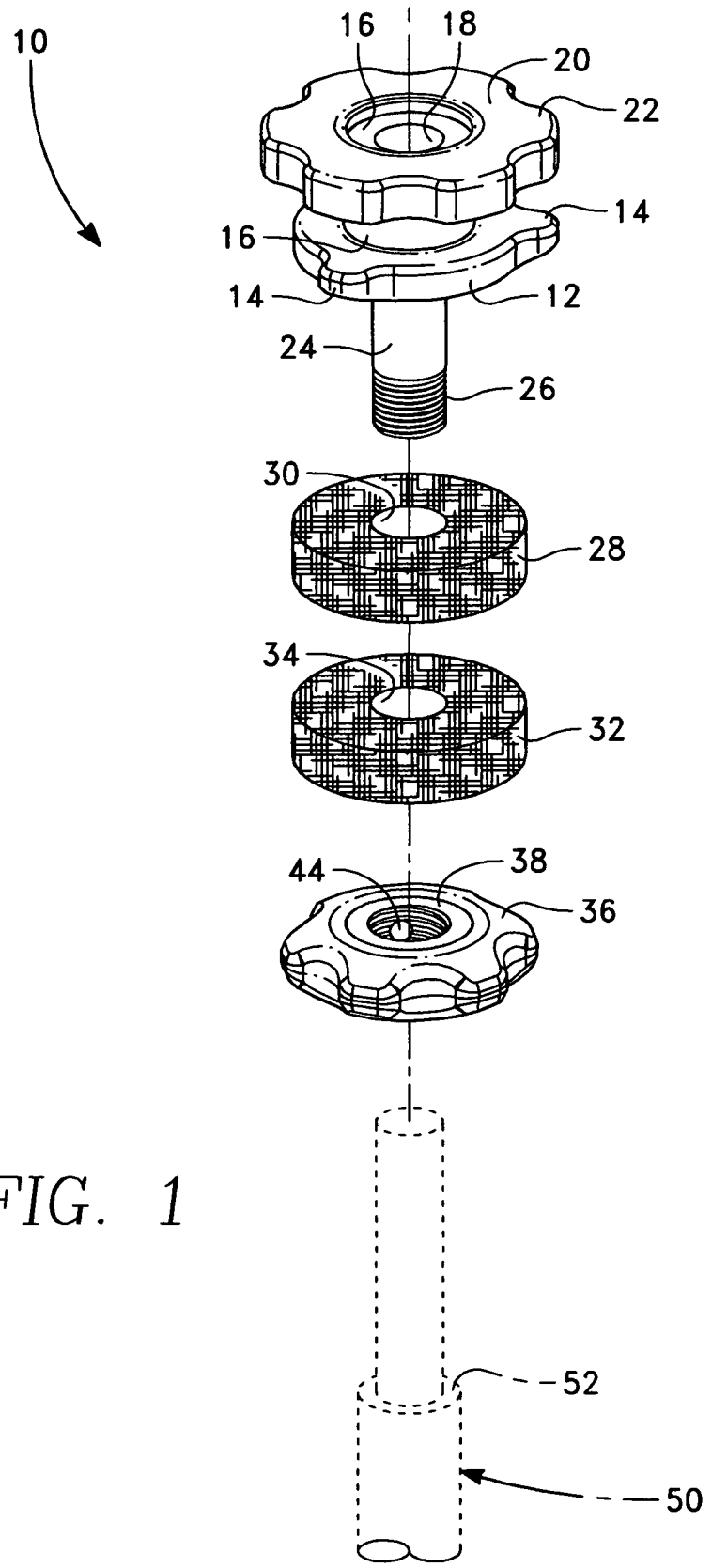
FIG. 1 is an exploded isometric view of the first embodiment of cymbal mounting assembly of this invention.
Figure 2:
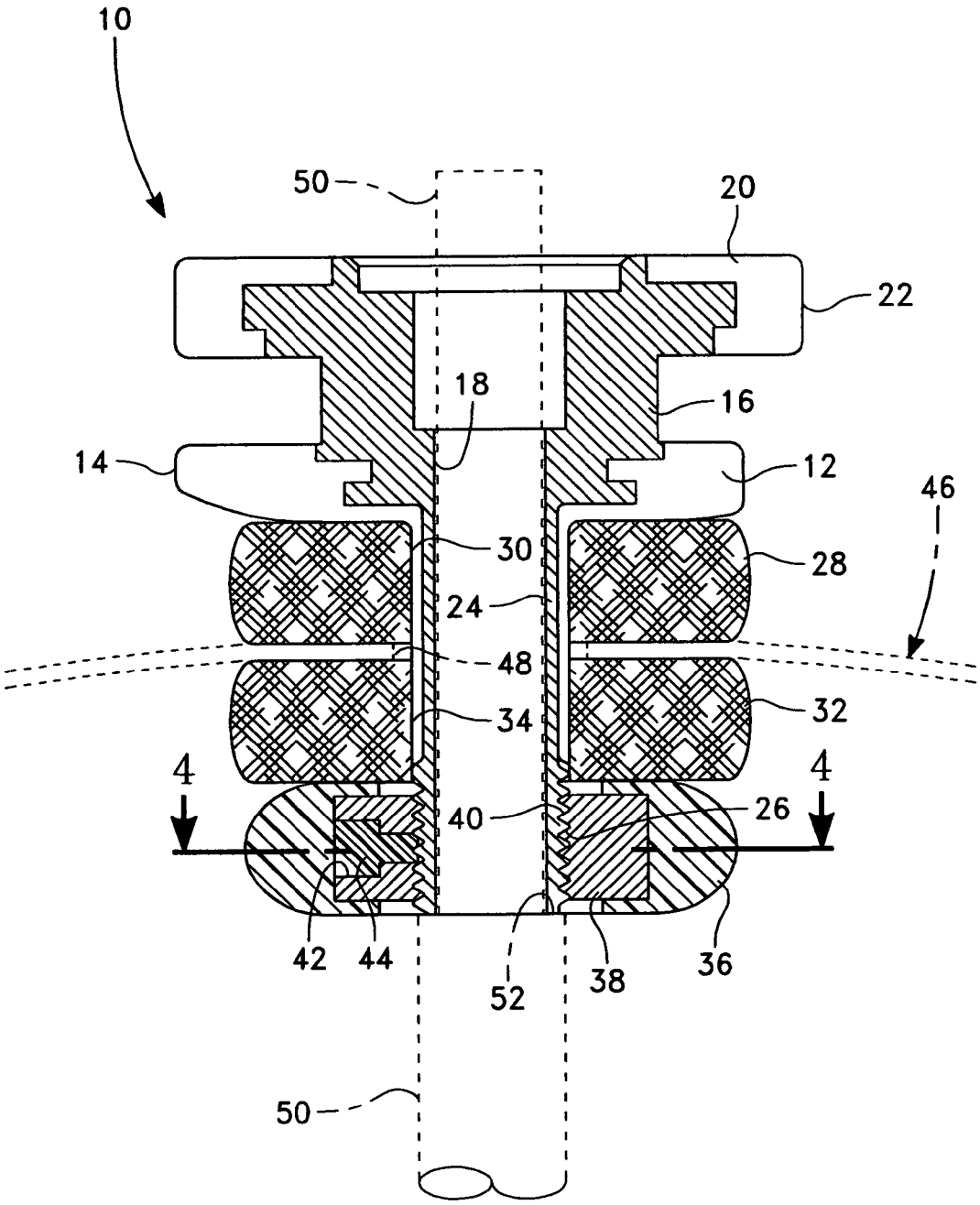
FIG. 2 is a longitudinal cross sectional view of the cymbal mounting assembly of FIG. 1.

Referring specifically to FIGS. 1 and 2 of the drawings there is shown the first embodiment of cymbal mounting assembly of this invention. Ring 12 is constructed of plastic and has a plurality of equiangularly spaced apart protrusions 14. There are three in number of protrusions. Protrusions 14 facilitate manual grasping of the ring 12 by the drummer. The ring 12 is tightly mounted on a metal insert 16. Metal insert 16 has a center through hole 18. Fixedly secured to the upper end of the metal insert 16 is a knob 20. The annular periphery of the knob 20 includes a series of protrusions 22 which again are for the purpose of facilitating grasping by the drummer. Both the knob 20 and the ring 12 are located in the upper portion of the assembly 10.

Figure 3:
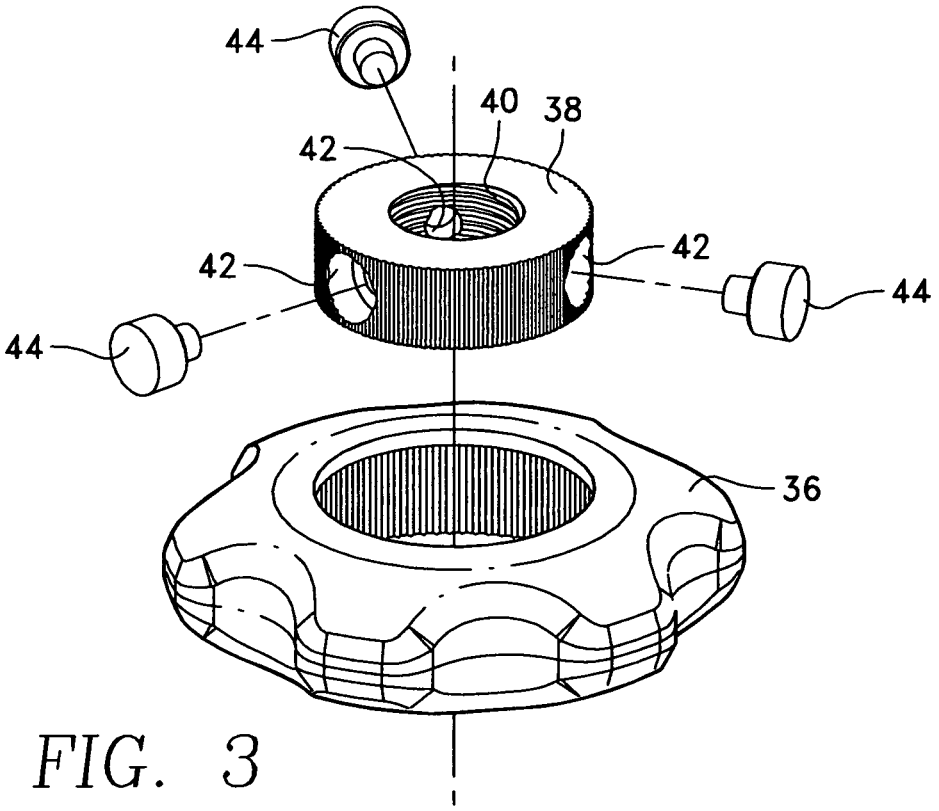
FIG. 3 is a disassembled isometric view of the tightening nut utilized in both embodiments of this invention.
Figure 4:
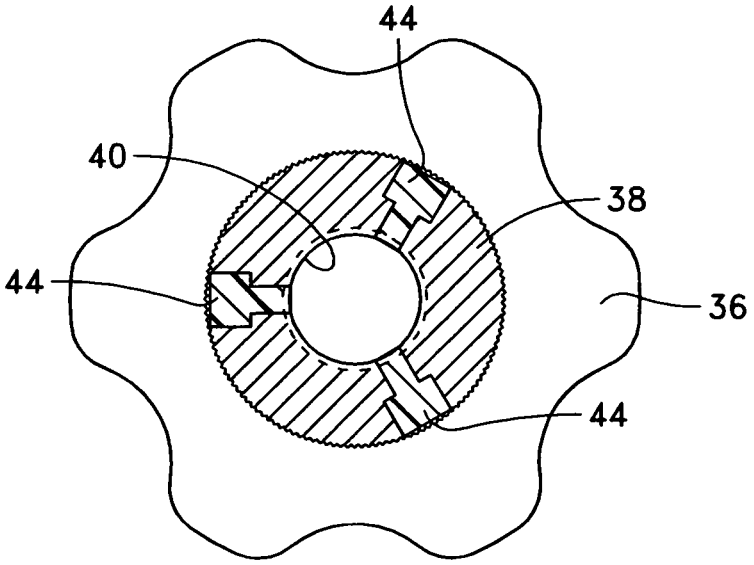
FIG. 4 is a top plan view of the tightening nut of FIG. 3.

Attached to the bottom surface of the metal insert 16 and is integral therewith is a tube 24 which is located at the lower portion of the assembly 10. Tube 24 has at its lower end a series of external screw threads 26. Located about the tube 26 is an upper soft disc 28, usually constructed of felt, which also has a center hole 30. Tube 24 extends through center hole 30. A lower soft disc, which is also of felt and generally is identical to disc 28, is also located about tube 24 which extends through center hole 34 formed in disc 32. Referring particularly to FIGS. 3 and 4, a tightening nut 36 has a plastic exterior which is molded tightly onto center ring 38. Center ring 38 is constructed of metal. Center ring 38 has a through hole 40 which is internally threaded. Center ring 38 has a plurality (three in number of equiangularly spaced apart) holes 42. Mounted within each hole 42 is a nylon insert 44. When tightening nut 36 is threadably mounted onto screw threads 26, the nylon inserts 44 are pressed against the threads 26 producing a frictional force which must be overcome when unattaching tightening nut 36 from the tube 24. The outer end of each nylon insert 44 abuts against the tightening nut 36.

Initially the tightening nut 36 is separated from tube 24 as well as the lower soft disc 32. A cymbal 46 connects with cymbal mounting assembly by the center hole 48 being located about tube 24 and against cymbal 46 being located about tube 24 and against cymbal 46 being located against soft disc 28. Soft disc 32 is then installed with tube 24 being located within center hole 34. Soft disc 32 is now located against the underside of the cymbal 46. Tightening nut 36 is then threaded onto threads 26. Tightening nut 36 could be located loosely which will permit the cymbal to rock or pivot freely producing a sharp sound when struck by the drumstick or the tightening nut 36 could be turned tighter which presses soft discs 28 and 32 toward each other clamping tightly onto the cymbal 46 which will produce a muted sound when the cymbal is struck. The drummer then places the cymbal mounting assembly on a mounting rod 50 of a cymbal stand not shown. The tightening nut 36 will rest on annular ledge 52 of the mounting rod 50. There is no attachment to the mounting rod 50 as the cymbal mounting assembly merely rests on the ledge 52.

Figure 5:
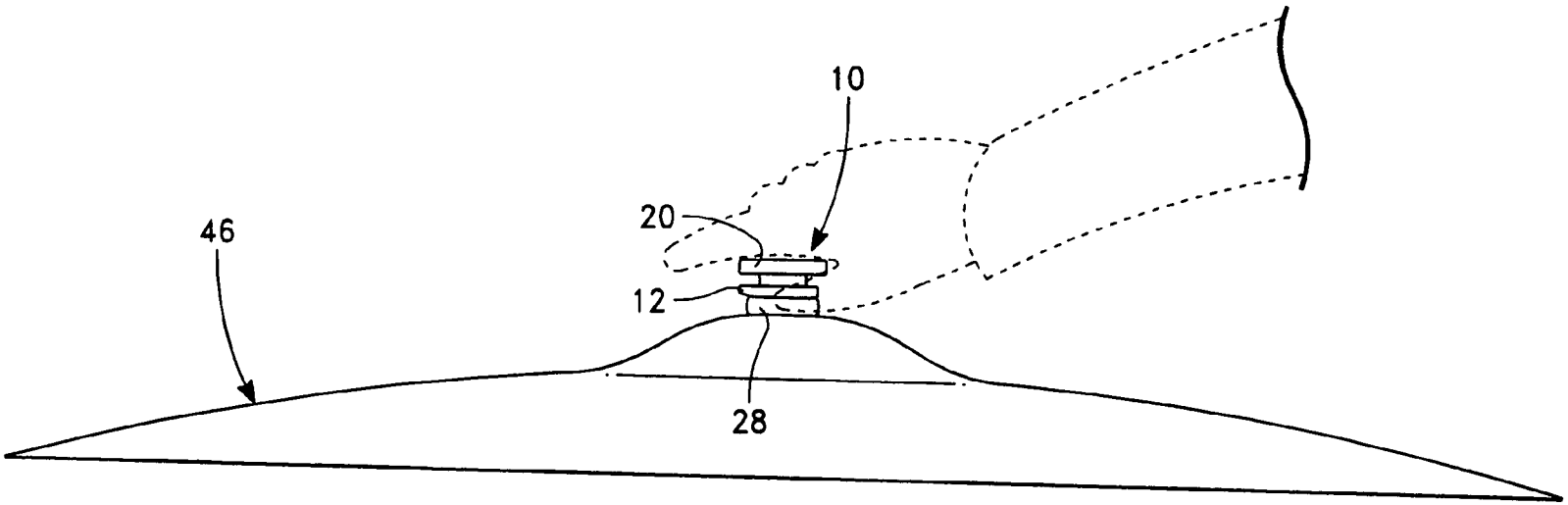
FIG. 5 is a side view depicting the installation of the cymbal mounting assembly in conjunction with a cymbal showing how a drummer could grasp the cymbal mounting assembly of this invention.

Another way the cymbal 46 could be played is for the drummer to pick up the ring 12 and knob 20 and separate the cymbal mounting assembly 10 from the mounting rod 50 as is shown in FIG. 5. With the drummer holding the cymbal 46 in a suspended position, the drummer can strike the cymbal 46 using his or her other hand.

Figure 6:
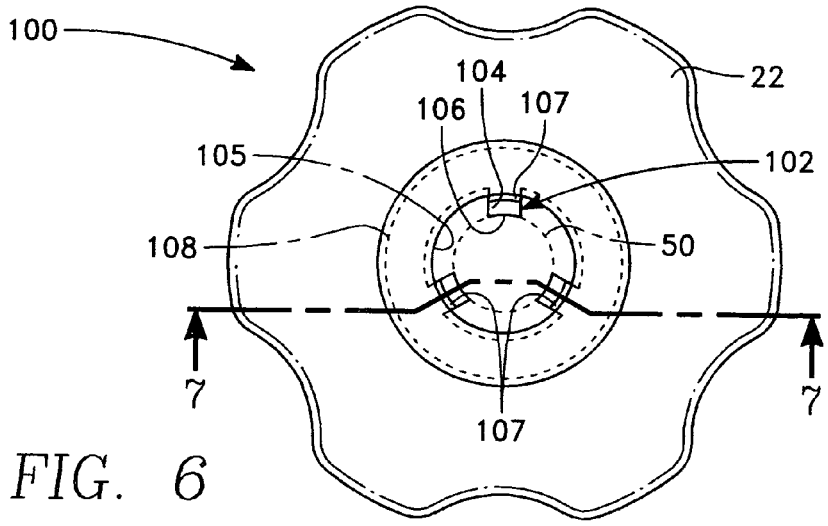
FIG. 6 is a top plan view of the second embodiment where the knob includes the centering clip.
Figure 7:
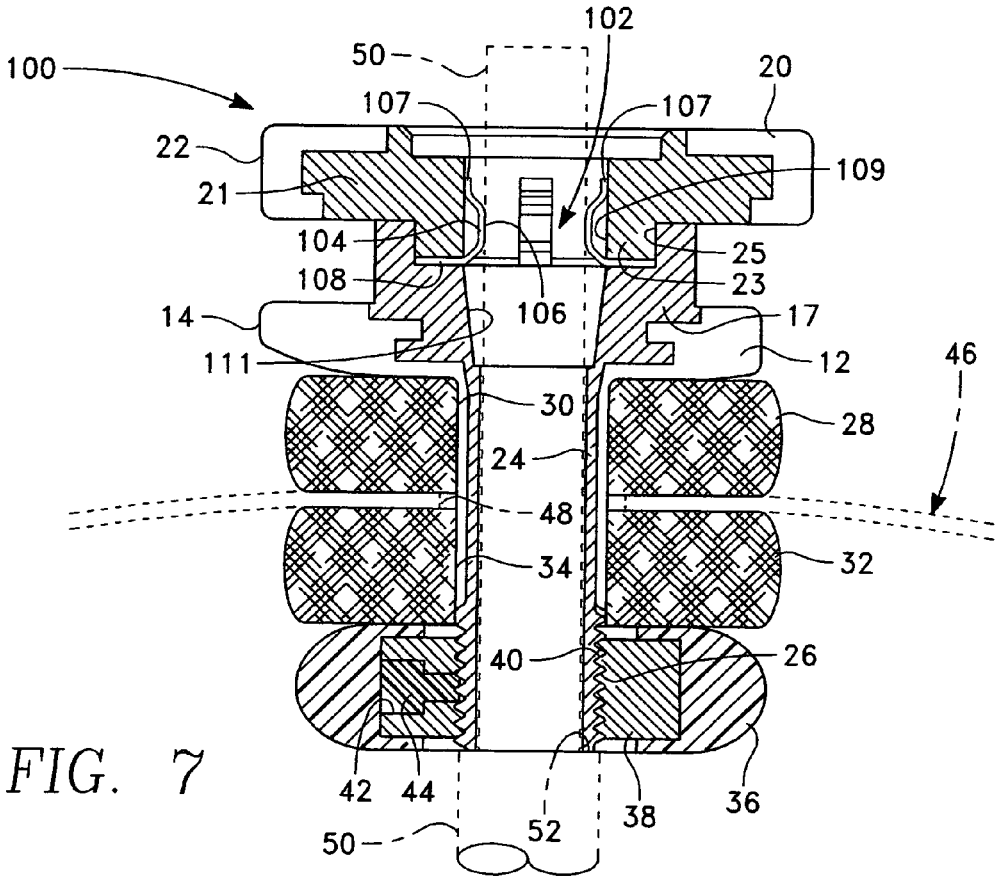
FIG. 7 is a longitudinal cross sectional view of the cymbal mounting assembly taken along line 7-7 of FIG. 6.

It has been discovered that when playing of the cymbal 46 that the vibration of the cymbal will cause the metal insert 16 to vibrate against the mounting rod 50 creating an undesirable "rattling" or "buzzing" sound. To avoid this there is shown a second embodiment 100. The metal insert 16 is constructed of two separate pieces, an upper piece 21 and a lower piece 17. Upper piece 21 has a narrowed annular shoulder 23 which is press fitted within a circular cavity 25 formed within lower piece 17. A metal centering clip 102 has a thin annular base 108 which surrounds a center hole 105. The base 108 is to be tightly clamped between the pieces 17 and 21 with the annular base 108 located in circular cavity 25. Integral with annular base. 108 are a plurality of spring fingers 104. There are three in number of spring fingers 104 shown in FIG. 6 equiangularly spaced apart but this number could be increased or decreased. Each spring finger 104 extends outwardly from annular base 108. Each spring finger 104 has a tip 107 which is to contact the upper piece 21. Each spring finger 104 also has a bowed center section which forms a contact point 106 with the mounting rod 50. This centering clip 102 keeps the mounting rod 50 centered within through hole 109 of the upper piece 21 and also centered relative tapered hole 11 of lower piece 17. The spring fingers 104 function to apply a resilient force against the mounting rod 50 as the space enclosed by the fingers 104 is slightly less than the diameter of the mounting rod 50. Therefore when the mounting rod 50 is inserted between the fingers 104, the fingers 104 slightly deflect achieving a springyness. Therefore, the centering clip 102 prevents any contact between the pieces 17 and 21 and mounting rod 50 preventing any undesirable noise. The tube 24 is integral with and extends from lower piece 17. The upper piece 21, lower piece 17 and tube 24 are considered to be the housing.

The invention claimed is:

1. A cymbal mounting assembly to be placed on a mounting rod of a cymbal stand comprising:

a housing having a longitudinally centrally located through hole, the mounting rod is to be located within said through hole, said housing having an enlarged upper end, a knob secured to said enlarged upper end, said knob having a centrally located through hole that aligns with said through hole of said housing;

a pair of soft discs mounted on said housing, a cymbal to be located between said discs;

a tightening nut threadably mounted on said housing and abutting one of said soft discs, turning of said nut causing movement of said nut toward a said disc applies a compressive force to said discs which secures in place the cymbal.

2. The cymbal mounting assembly as defined in claim 1 wherein:

said through hole of said housing having a constant diameter.

3. The cymbal mounting assembly as defined in claim 1 wherein:

said tightening nut includes a nylon pin that presses against said housing to apply a frictional force preventing free turning of said tightening nut, turning of said nut is to occur only by application of a turning force overcoming said frictional force, upon release of the force from said tightening nut results in said tightening nut staying in its established position.

4. The cymbal mounting assembly as defined in claim 2 wherein:

therebeing a plurality of said nylon pins.

5. A cymbal mounting assembly to be placed on a mounting rod of a cymbal stand comprising:

a knob having a center upper piece, said upper piece having an annular shoulder;

a ring having a center lower piece, said lower piece having a circular cavity, said annular shoulder resting within said circular cavity;

a centering clip being clamped between said annular shoulder and said circular cavity, said centering clip adapted to abut against the mounting rod keeping same centered and spaced from said knob and ring;

a tube extending from said lower piece, a pair of soft discs mounted on said tube, a cymbal to be located between said discs; and a tightening nut threadably mounted on said tube an abutting one of said soft discs, turning of said nut causing movement of said nut toward a said soft disc applying a compressive force to said discs which secures in place the cymbal.

6. The cymbal mounting assembly as defined in claim 4 wherein:

said centering clip having a plurality of spring fingers which resiliently contact both said upper piece and the mounting rod, said spring fingers being mounted on an annular thin base which is clamped between said upper piece and said lower piece, said spring fingers extending outwardly from said base.

7. The cymbal mounting assembly as defined in claim 6 wherein:

each said spring finger of said spring fingers having a bowed center section connected to a free end defined as a tip, said bowed center section to be in contact with the mounting rod, said tip being in contact with said upper piece.

* * * * *